US011185967B2

(12) United States Patent
Oouchi

(10) Patent No.: US 11,185,967 B2
(45) Date of Patent: Nov. 30, 2021

(54) DRIVING TOOL

(71) Applicant: KOKI HOLDINGS CO., LTD., Tokyo (JP)

(72) Inventor: Haruhiko Oouchi, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 188 days.

(21) Appl. No.: 16/067,107

(22) PCT Filed: Nov. 25, 2016

(86) PCT No.: PCT/JP2016/084953
§ 371 (c)(1),
(2) Date: Jun. 28, 2018

(87) PCT Pub. No.: WO2017/115593
PCT Pub. Date: Jul. 6, 2017

(65) Prior Publication Data

US 2019/0022842 A1 Jan. 24, 2019

(30) Foreign Application Priority Data

Dec. 28, 2015 (JP) ..... JP2015-257277

(51) Int. Cl.
*B25C 1/04* (2006.01)
*B25C 7/00* (2006.01)
*B25C 1/00* (2006.01)

(52) U.S. Cl.
CPC ..... *B25C 1/047* (2013.01); *B25C 1/008* (2013.01); *B25C 1/04* (2013.01); *B25C 1/042* (2013.01); *B25C 1/043* (2013.01); *B25C 7/00* (2013.01)

(58) Field of Classification Search
CPC ..... B25C 1/008; B25C 1/04; B25C 1/042; B25C 1/043; B25C 1/047; B25C 1/046;
(Continued)

(56) References Cited

U.S. PATENT DOCUMENTS 3,259,025 A * 7/1966 Kessler ..... B25B 23/1453 91/1
3,527,142 A * 9/1970 Obergfell ..... B25C 1/041 91/461
(Continued)

FOREIGN PATENT DOCUMENTS

JP H02-070980 U 5/1990
JP H08-276375 A 10/1996
(Continued)

OTHER PUBLICATIONS

Search Report issued in corresponding International Patent Application No. PCT/JP2016/084953, dated Jan. 24, 2017.
(Continued)

*Primary Examiner* — Robert F Long
(74) *Attorney, Agent, or Firm* — McDermott Will & Emery LLP

(57) ABSTRACT

A driving tool capable of avoiding blank shot after a predetermined time has elapsed when performing a bump firing and capable of smoothly performing the bump firing is provided. The driving tool includes: an accumulator chamber which accumulates compressed air; a nose section provided on a housing; a cylinder; a trigger; and a push lever provided in the nose section, and when the trigger and the push lever are operated, the compressed air is supplied into the cylinder. The driving tool further includes: a delay valve which prevents the compressed air from being supplied into the cylinder when the push lever is not operated within a predetermined time after the trigger is operated: and a switching valve which supplies the compressed air of the accumulator chamber to the delay valve when the trigger is operated, and discharges the compressed air supplied to the delay valve to an outside of the housing when the push lever is operated within the predetermined time.

8 Claims, 16 Drawing Sheets

(58) Field of Classification Search
CPC ..... B25C 7/00; B25C 5/01–7; B23B 45/00; B23C 1/20; B23Q 11/1092; B23Q 5/01–7; B25B 19/00; B25B 5/01–7; B25D 5/01–7; B25F 5/01–7; B26C 5/01–7
USPC ..... 173/1–11, 176–178, 90; 227/1–7, 227/108–151
See application file for complete search history.

(56) References Cited

U.S. PATENT DOCUMENTS 3,605,559 A * 9/1971 Korth ..... B27F 7/34 91/398
3,964,659 A 6/1976 Eiben et al.
4,053,093 A * 10/1977 Thueringer ..... B25C 1/041 227/5
4,679,719 A * 7/1987 Kramer ..... B25C 1/04 227/131
4,736,879 A * 4/1988 Yamada ..... B25C 1/041 227/130
5,020,712 A * 6/1991 Monacelli ..... B25C 1/04 227/120
5,720,423 A * 2/1998 Kondo ..... B25C 1/04 227/130
5,732,870 A * 3/1998 Moorman ..... B25C 1/008 227/130
5,772,096 A 6/1998 Osuka et al.
7,296,721 B1 * 11/2007 Wen ..... B25C 1/045 227/130
9,764,456 B2 * 9/2017 Li ..... B25C 1/047
10,335,874 B2 * 7/2019 Iwata ..... B23D 51/10
2002/0125290 A1 * 9/2002 Robinson ..... B25C 1/043 227/8
2009/0242604 A1 * 10/2009 Mina ..... B25C 1/047 227/8
2010/0213235 A1 * 8/2010 Pedicini ..... B25C 1/047 227/130
2013/0082083 A1 * 4/2013 Largo ..... B25C 1/041 227/8
2014/0110452 A1 4/2014 Moore et al.
2014/0158740 A1 * 6/2014 Akutsu ..... B25C 1/044 227/130
2015/0158160 A1 * 6/2015 Kato ..... F15B 15/149 91/35
2016/0114470 A1 * 4/2016 Weigmann ..... B25C 1/047 227/8
2016/0158927 A1 * 6/2016 Largo ..... B25C 1/04 220/582
2018/0117747 A1 * 5/2018 Hahndel ..... B25C 1/047

FOREIGN PATENT DOCUMENTS

JP 2012-111017 A 6/2012
WO 2014/209482 A1 12/2014
WO WO 2014/209482 * 12/2014

OTHER PUBLICATIONS

Extended European Search Report issued in corresponding European Patent Application No. 16881573.6-1017, dated Feb. 4, 2020.
Chinese Office Action issued in corresponding Chinese Patent Application No. 201680076996.1, dated Oct. 10, 2020, with English translation.

* cited by examiner

19 : ACCUMULATOR CHAMBER
26 : DELAY VALVE
27 : SWITCHING VALVE

DRIVING TOOL

CROSS REFERENCE

This application is the U.S. National Phase under 35 U.S.C. § 371 of International Application No. PCT/JP2016/084953, filed on Nov. 25, 2016, which claims the benefit of Japanese Application No. 2015-257277, filed on Dec. 28, 2015, the entire contents of each are hereby incorporated by reference.

TECHNICAL FIELD

The present invention relates to a driving tool that operates a striker by a pneumatic pressure of an accumulator chamber to strike a fastener.

BACKGROUND ART

A driving tool is described in Patent Document 1. The driving tool described in Patent Document 1 includes a trigger which is provided on a housing and is moved by an operating force of a worker and a pressing member which is provided on the housing and is pressed against an object to which a fastener is driven.

The driving tool described in Patent Document 1 includes a first valve which is operated by a moving force of the trigger to establish or shut off a connection between an accumulator chamber and a first passage and a second valve which is operated by a moving force of the pressing member to establish or shut off a connection between the first passage and a second passage.

The driving tool described in Patent Document 1 includes a cylinder which is movably provided in the housing, an upper cylinder chamber which communicates with the second passage, a striking chamber which is connected to or shut off from the accumulator chamber by an operation of the cylinder, and a striker which is provided in the cylinder and is operated by pressure of the striking chamber.

The driving tool described in Patent Document 1 is selectable between a bump fire mode and a single fire mode. In the bump fire mode, a fastener is struck by alternately repeating an operation in which the pressing member is pressed against the object and an operation in which the pressing member is separated from the object in a state where air of the accumulator chamber is supplied to the first passage by applying an operating force to the trigger.

In the single fire mode, an operation in which an operating force is applied to the trigger and the pressing member is pressed against the object to strike a fastener and an operation in which the operating force applied to the trigger is released and the pressing member is separated from the object are alternately repeated.

RELATED ART DOCUMENTS

Patent Documents

Patent Document 1: Japanese Patent Application Laid-Open Publication No. 2012-111017

SUMMARY OF THE INVENTION

Problem to be Solved by the Invention

When a driving tool is set to a bump fire mode by a worker, even in a case where the worker has detached fasteners from the driving tool to end the work, a driving operation is unintentionally made, that is, blank shot is fired if a push lever is in contact with an object in a workplace in a state where air of an accumulator chamber is supplied to a first passage by applying an operating force to a trigger, with the result that lifetime of a damper is shortened.

An object of the present invention is to provide a driving tool capable of preventing blank shot from occurring after a predetermined time has elapsed in a state where air of an accumulator chamber is supplied to a first passage for bump firing and capable of smoothly performing the bump firing.

Means for Solving the Problems

The driving tool according to an embodiment has a housing, an accumulator chamber which accumulates compressed air in the housing, a nose section provided on the housing, a cylinder provided in the housing, a trigger provided on the housing, and a push lever provided in the nose section and allowed to abut on a material to which driving is performed, the trigger and the push lever are operated such that the compressed air of the accumulator chamber is supplied to the cylinder, and the driving tool includes: a control valve which is operated so as to prevent the compressed air of the accumulator chamber from being supplied to the cylinder when the push lever is not operated within a predetermined time after the trigger is operated; and a switching valve which supplies the compressed air of the accumulator chamber to the control valve when the trigger is operated, and discharges the compressed air supplied to the control valve to outside of the housing when the push lever is operated within the predetermined time.

The driving tool according to another embodiment has an accumulator chamber to which air is injected, a striking chamber to which air is supplied from the accumulator chamber, and a striker which is operated by a pneumatic pressure of the striking chamber to strike a fastener, the driving tool includes: a trigger moved by an operating force of a worker; a push lever moved by being pressed against an object to which the fastener is driven; a trigger valve operated by a moving force of the trigger to establish or shut off a connection between the accumulator chamber and a first passage; a safety valve operated by a moving force of the push lever to establish or shut off a connection between the first passage and a second passage; a third passage formed between the second passage and the striking chamber; a main valve operated by a pneumatic pressure of the third passage to establish or shut off a connection between the accumulator chamber and the striking chamber; a shutoff valve operated by a pneumatic pressure of a control port to establish or shut off a connection between the second passage and the third passage; a supply port which supplies the air of the accumulator chamber to the control port; a control valve having a first control state in which the supply port is closed to change the pneumatic pressure of the control port to a first control pressure and a second control state in which the supply port is opened to change the pneumatic pressure of the control port to a second control pressure higher than the first control pressure; a fourth passage connected to the supply port; and a switching valve having a first switch state in which the first passage and the fourth passage are connected and a second switch state in which the connection between the first passage and the fourth passage is shut off, the switching valve is brought in the first switch state when the accumulator chamber and the first passage are connected by the trigger valve in a state where the connection between the first passage and the second passage is shut off by the safety valve, the control valve is in the first control state until a predetermined time elapses from a time when the switching valve is brought in the first switch state and the first control state is switched to the second control state when the predetermined time has elapsed, and the switching valve is switched from the first switch state to the second switch state when the first passage and the second passage are connected by the safety valve and the air of the accumulator chamber is supplied to the striking chamber such that the striker strikes the fastener before the predetermined time has elapsed.

Effects of the Invention

In the driving tool according to the embodiment, when a push lever is operated before a predetermined time has elapsed after compressed air of an accumulator chamber is supplied to a control valve, the compressed air supplied to the control valve is discharged to the outside of the housing. Thus, it is possible to prevent the blank shot from occurring.

BRIEF DESCRIPTION OF TEE DRAWINGS

DETAILED DESCRIPTION OF PREFERRED EMBODIMENTS

Hereinafter, an embodiment of a driving tool will be described in detail with reference to the drawings.

Figure 1:
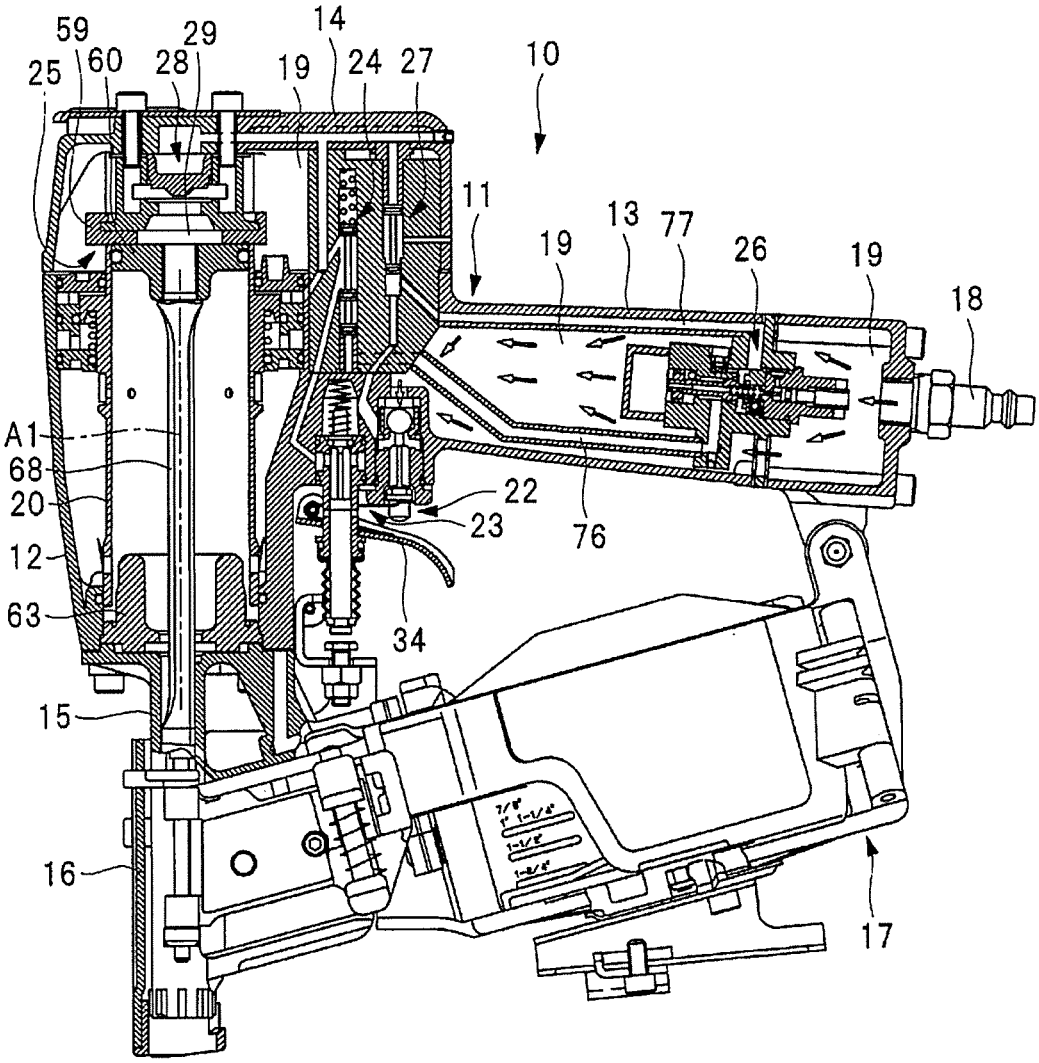
FIG. 1 is a longitudinal cross-sectional view showing a driving tool seen from a side.

A driving tool 10 shown in FIG. 1 has a hollow housing 11, and the housing 11 includes a cylinder case 12, a handle 13 fixed to the cylinder case 12, a cover 14 which closes an opening of the cylinder case 12, a nose section 15 fixed to the cylinder case 12, and a push lever 16 attached to the nose section 15. Further, a magazine 17 is attached to the nose section 15. A plug 18 is attached to the handle 13, and an air hose is attached to and detached from the plug 18.

The air hose is connected to an air compressor. An accumulator chamber 19 is provided in the housing 11, and the air compressed by the air compressor connected to the air hose is injected into the accumulator chamber 19 through the air hose.

Although there are a plurality of reference characters of the accumulator chamber 19 in FIG. 1, the accumulator chamber 19 is connected as a whole, meaning that there are not a plurality of accumulator chambers 19 provided independently.

A cylinder 20, an upper cylinder chamber 21, a trigger valve 22, a safety valve 23, a shutoff valve 24, a main valve 25, a delay valve 26, a switching valve 27, an exhaust valve 28, and a striking chamber 29 are provided in the housing 11. A passage 31 and an atmospheric port 33 are provided in the housing 11. A trigger 34 is attached to the housing 11 with a support shaft 35 as a fulcrum, and an elastic member 36 biases the trigger 34 in a rotating direction. The trigger 34 is a lever to which an operating force of a worker is applied. The elastic member 36 is a torsion coil spring made of metal.

Figure 2:
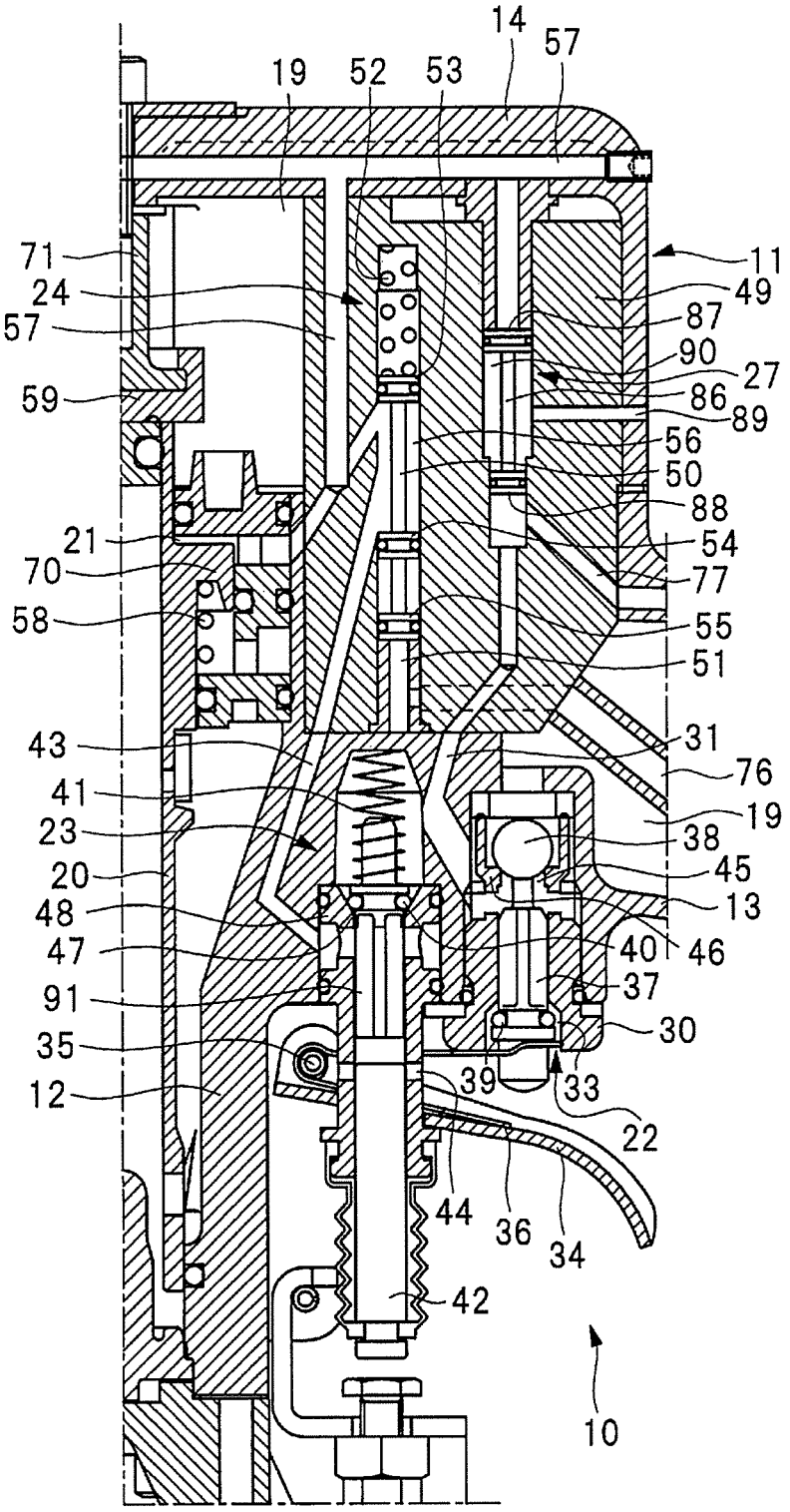
FIG. 2 is a longitudinal cross-sectional view showing a valve mechanism of the driving tool of FIG. 1.

When a worker applies an operating force to the trigger 34, the trigger 34 rotates anticlockwise in FIG. 2 against the force of the elastic member 36. When the worker releases the operating force, the trigger 34 rotates clockwise by the force of the elastic member 36, and the trigger 34 stops in contact with a stopper. The trigger valve 22 has a tubular member 30 fixed to the housing 11, an atmospheric port 33 provided in the tubular member 30, a valve stem 37 movable in the tubular member 30, a ball 38 as a valve element, a valve seat 46 provided with a port 45, and a seal member 39 attached to the valve stem 37. The valve stem 37 is supported by the elastic member 36 in the atmospheric port 33.

A rotating force of the trigger 34 is transmitted to the valve stem 37, so that the trigger valve 22 is operated. An operating state of the trigger valve 22 is switchable between an ON state and an OFF state. When the trigger valve 22 is in the OFF state, the ball 38 is pushed by a pneumatic pressure of the accumulator chamber 19, and the ball 38 is pressed to the valve seat 46. Namely, the port 45 is closed to shut off a connection between the accumulator chamber 19 and the passage 31. Also, when the trigger valve 22 is in the OFF state, the passage 31 and the atmospheric port 33 are connected. When the trigger valve 22 is in the ON state, the ball 38 is pushed by the valve stem 37 to open the port 45, so that the accumulator chamber 19 and the passage 31 are connected. Also, when the trigger valve 22 is in the ON state, the seal member 39 shuts off the atmospheric port 33.

The safety valve 23 has a valve stem 91, a seal member 40 attached to the valve stem 91, an elastic member 41 for biasing the valve stem 91, a valve seat 48 having a port 47, and a movable intermediate shaft 42. The elastic member 41 is a compression coil spring made of metal. The push lever 16 has a tubular shape and is movable in a direction of a center line A1 of the cylinder 20.

The moving force of the push lever 16 is transmitted to the valve stem 91 via the intermediate shaft 42. The push lever 16 stops at a standby position by a stopper. When the push lever 16 is pressed against the object serving as a material to which fasteners are to be driven, the moving force of the push lever 16 is transmitted to the valve stem 91 via the intermediate shaft 42, and the valve stem 91 moves against the force of the elastic member 41. In addition, a passage 43 and an atmospheric port 44 are provided in the housing 11.

The operating state of the safety valve 23 is switched in accordance with the operating state of the push lever 16. The safety valve 23 connects the passage 43 to either the passage 31 or the atmospheric port 44. When the push lever 16 stops at the standby position, the operating state of the safety valve 23 is in an OFF state. When the push lever 16 abuts on the object and is moved from the standby position, the operating state of the safety valve 23 is switched to an ON state.

When the safety valve 23 is in an OFF state, the passage 43 and the atmospheric port 44 are connected, and the seal member 40 is pressed to the valve seat 48 to close the port 47. Namely, the safety valve 23 shuts off the connection between the passage 31 and the passage 43. When the safety valve 23 is in an ON state, the seal member 40 is separated from the valve seat 48 to open the port 47, so that the passage 31 and the passage 43 are connected. When the safety valve 23 is in an OFF state, the intermediate shaft 42 shuts off the connection between the passage 43 and the atmospheric port 33.

A valve body 49 is installed in the housing 11. The valve body 49 is a metal block, and the shutoff valve 24 is provided in the valve body 49. The shutoff valve 24 has a movable spool 50, a control port 51, and an elastic member 52 for biasing the spool 50. The spool 50 has three land portions 53, 54, and 55, and an air chamber 56 is formed between the land portion 53 and the land portion 54. The elastic member 52 is a compression coil spring made of metal, and the land portion 53 receives a force of the elastic member 52. The land portion 54 establishes or shuts off a connection between the air chamber 56 and the passage 43, and the land portion 55 receives a pneumatic pressure of the control port 51. The air chamber 56 is always connected to the passage 57.

A pneumatic pressure is supplied to the control port 51, and the spool 50 is biased in a direction opposite to the force of the elastic member 52 by the pneumatic pressure of the control port 51. The operating state of the shutoff valve 24 is switched in accordance with the pneumatic pressure of the control port 51. When the pneumatic pressure of the control port 51 is at a first control pressure, the shutoff valve 24 is brought in a first operating state, and when the pneumatic pressure of the control port 51 is at a second control pressure, the shutoff valve 24 is brought in a second operating state. The second control pressure is higher than the first control pressure. When the shutoff valve 24 is in the first operating state, the passage 43 and the passage 57 are connected. When the shutoff valve 24 is in the second operating state, the connection between the passage 43 and the passage 57 is shut off.

Figure 3:
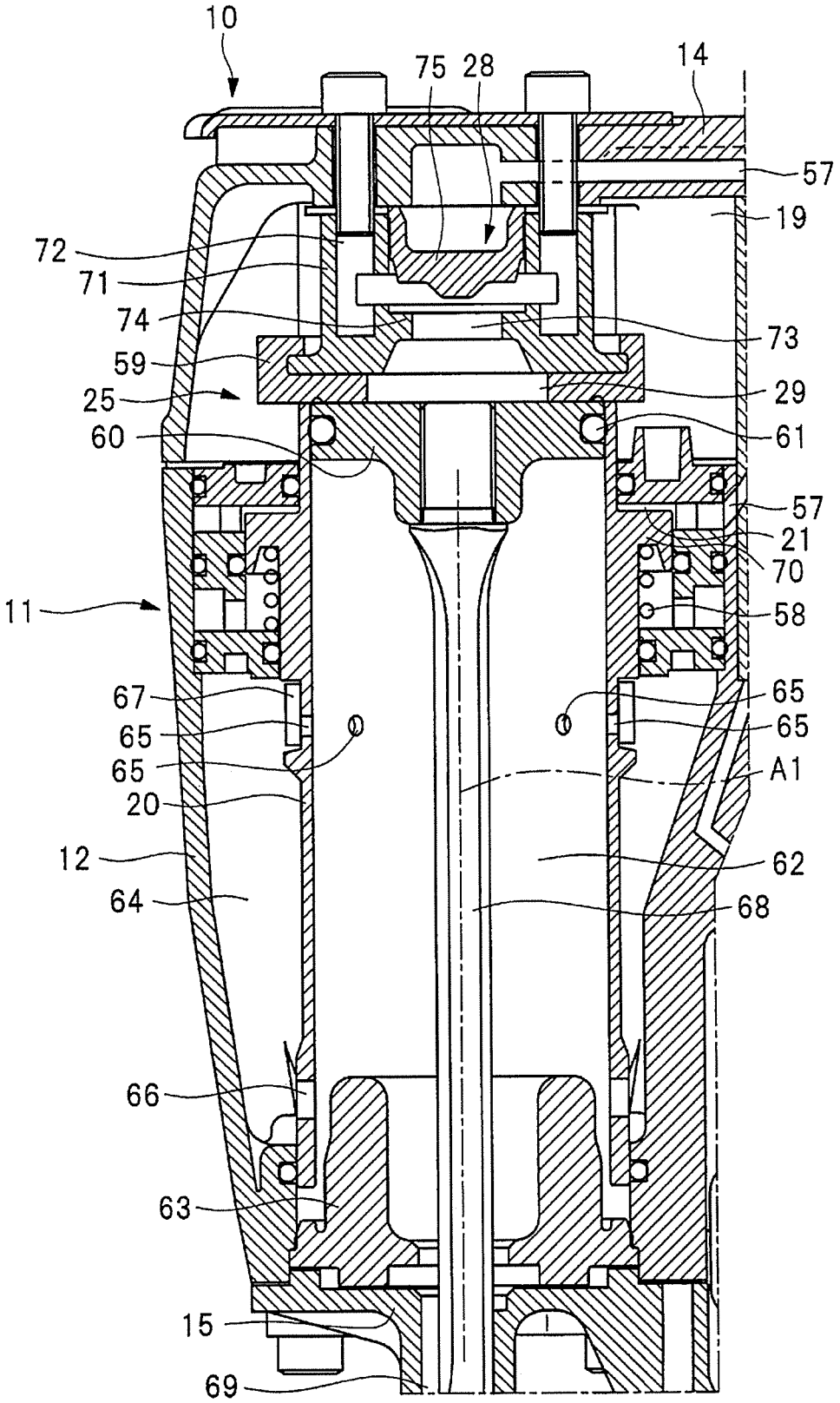
FIG. 3 is a longitudinal cross-sectional view showing a striking mechanism of the driving tool of FIG. 1.

As shown in FIG. 3, the cylinder 20 is disposed in the cylinder case 12 so as to be movable in the direction of the center line 1A. An elastic member 58 is provided in the housing 11, and the elastic member 58 is a compression coil spring made of metal. The elastic member 58 biases the cylinder 20 in a direction apart from the nose section 15. A stopper 59 is provided in the housing 11, and the stopper 59 is fixed to the housing 11 via a mount 71. The cylinder 20 biased by a force of the elastic member 58 stops in contact with the stopper 59. A piston 60 is disposed in the cylinder 20, and the piston 60 is movable in the direction of the center line A1. A seal member 61 is attached on an outer peripheral surface of the piston 60. A lower cylinder chamber 62 is formed between the nose section 15 and the piston 60 inside the cylinder 20. An annular damper 63 is provided in the lower cylinder chamber 62. The damper 63 is fixed in a state of being in contact with the nose section 15. The damper 63 is made of synthetic rubber.

A return air chamber 64 is formed in the housing 11. The return air chamber 64 is present outside the cylinder 20 in a radial direction of the cylinder 20. The cylinder 20 has two passages 65 and 66. The two passages 65 and 66 are disposed at positions different in the direction of the center line A1. The two passages 65 and 66 penetrate through the cylinder 20 in the radial direction. The passage 65 connects the lower cylinder chamber 62 and the return air chamber 64. A check valve 67 is provided in the cylinder 20, and when a pneumatic pressure of the lower cylinder chamber 62 is higher than a pneumatic pressure of the return air chamber 64, the check valve 67 opens the passage 65. The check valve 67 shuts off the passage 65 when the pneumatic pressure of the return air chamber 64 is higher than the pneumatic pressure of the lower cylinder chamber 62.

A striker 68 is fixed to the piston 60. An injection passage 69 is provided in the nose section 15. A plurality of fasteners S1 are accommodated in the magazine 17, and the fasteners S1 are sequentially supplied from the inside of the magazine 17 toward the injection passage 69. The fastener S1 is a nail, and the striker 68 is movable in the direction of the center line A1 together with the piston 60 and strikes the fastener S1 supplied to the injection passage 69.

A flange 70 is provided so as to protrude from an outer peripheral surface of the cylinder 20, and the upper cylinder chamber 21 is formed between the flange 70 and the stopper 59. The upper cylinder chamber 21 is connected to the passage 57. The striking chamber 29 is formed of the stopper 59, the cylinder 20, and the mount 71. The piston 60 receives a pneumatic pressure of the compressed air supplied from the upper cylinder chamber 21 to the striking chamber 29. The flange 70 receives the pneumatic pressure of the upper cylinder chamber 21, and the cylinder 20 moves in the direction of the center line A1 against the force of the elastic member 58.

When the cylinder 20 is in contact with the stopper 59, the connection between the upper cylinder chamber 21 and the striking chamber 29 is shut off, and when the cylinder 20 is separated from the stopper 59, the upper cylinder chamber 21 and the striking chamber 29 are connected. In the present specification, the striking chamber 29 may be understood as an upper piston chamber. The cylinder 20 and the stopper 59 are elements constituting the main valve 25. When the pressure of the striking chamber 29 increase, the piston 60 is struck by the pressure of the striking chamber 29 and moves in a direction approaching the damper 63.

An atmospheric port 72 is provided in the mount 71. The exhaust valve 28 has a valve seat 74 having a port 73 and a valve element 75 which opens and closes the port 73. In the exhaust valve 28, the valve element 75 is operated by the difference between the pressure of the passage 57 and the pressure of the striking chamber 29, thereby opening or closing the port 73. When the pressure of the passage 57 is higher than the pressure of the striking chamber 29, the valve element 75 is pressed to the valve seat 74 to close the port 73. Namely, the connection between the striking chamber 29 and the atmospheric port 72 is shut off. When the pressure of the passage 57 is lower than the pressure of the striking chamber 29, the valve element 75 is separated from the valve seat 74 to open the port 73. Namely, the striking chamber 29 is connected to the atmospheric port 72.

Figure 4:
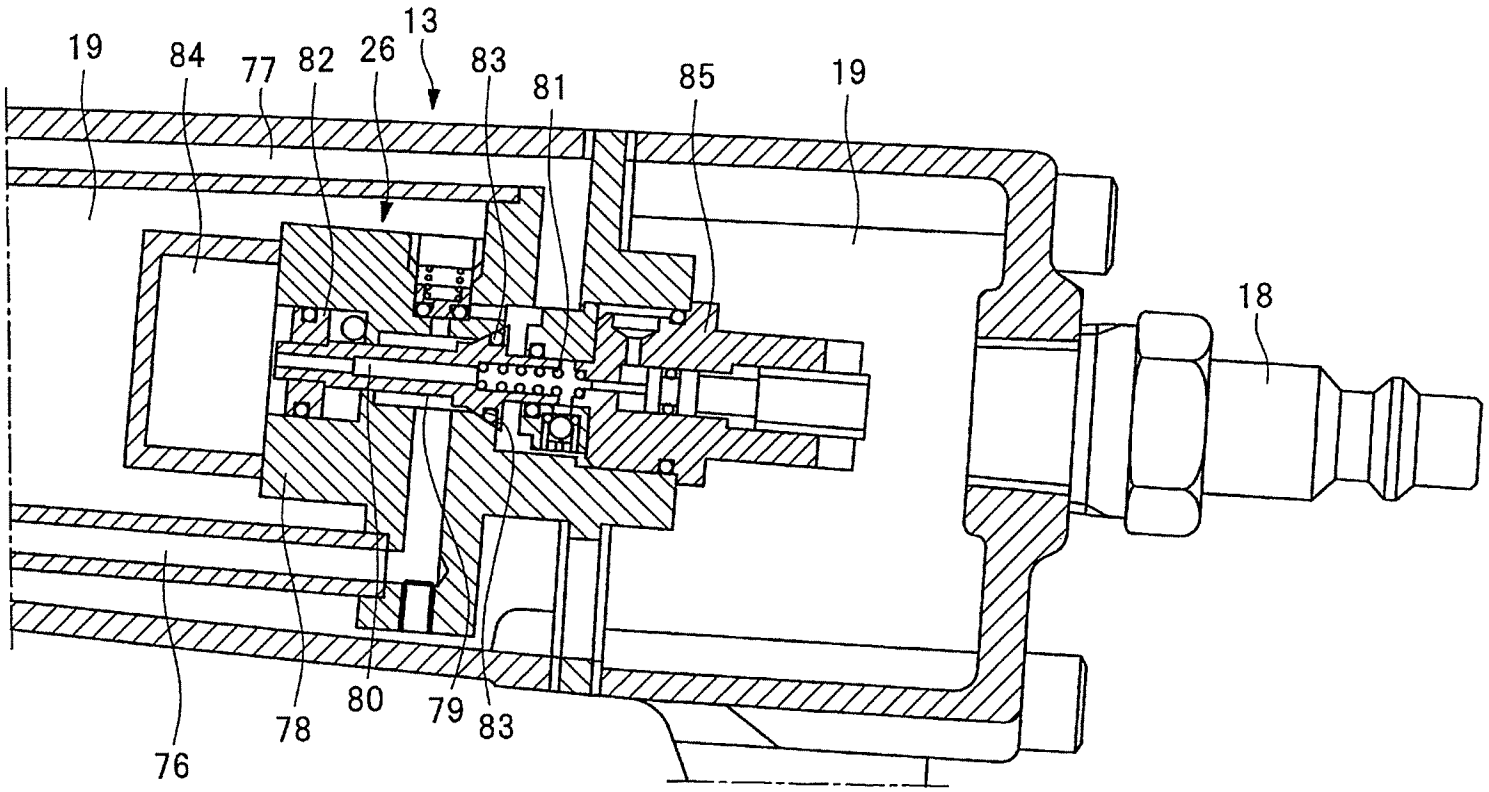
FIG. 4 is a longitudinal cross-sectional view showing an inside of a handle of the driving tool of FIG. 1.

As shown in FIG. 2, the passage 76 is connected to the control port 51, and the passage 77 is provided in the housing 11. The delay valve 26 establishes or shuts off a connection between the passage 76 and the passage 77. As shown in FIG. 4, the delay valve 26 has a valve body 78 fixedly provided in the handle 13, a valve element 79 movable with respect to the valve body 78, a passage 80 formed in the valve element 79, an elastic member 81 for biasing the valve element 79, a piston 82 attached to the valve element 79, a port 83 opened and closed by the valve element 79, a compression chamber 84 connected to the passage 80, and a plug 85 which closes an opening of the passage 80 on an opposite side of the compression chamber 84.

A flow area of the passage 80 is smaller than a flow area of the passage 77 and is narrower than a flow area of the compression chamber 84. Namely, the flow area of the passage 80 is narrower than the flow area of the other portions, and the passage 80 functions as an orifice. The elastic member 81 biases the valve element 79, and the piston 82 biases the valve element 79 in a direction opposite to the force of the elastic member 81 by the pressure of the compression chamber 84.

The switching valve 27 has a spool 86, land portions 87 and 88 provided on the spool 86, and an air chamber 90 connected to an atmospheric port 89. The air chamber 90 is provided between the land portion 87 and the land portion 88. The land portion 87 receives a pneumatic pressure of the passage 57, and the land portion 88 receives a pneumatic pressure of the passage 31. A pressure receiving area of the land portion 87 is wider than a pressure receiving area of the land portion 88.

The spool 86 is biased in a first direction by the pressure received by the land portion 87 and is biased in a second direction by the pressure received by the land portion 88. The first direction and the second direction are opposite to each other. The spool 86 is operated in an axial direction by the difference between the biasing force in the first direction and the biasing force in the second direction. The switching valve 27 is switched between a first switch state and a second switch state depending on a position of the spool 86 in the axial direction.

When the switching valve 27 is in the first switch state, the passage 77 and the air chamber 90 are connected, and the connection between the passage 31 and the passage 77 is shut off. Namely, the passage 77 and the atmospheric port 89 are connected. When the switching valve 27 is in the second switch state, the passage 31 and the passage 77 are connected, and the connection between the passage 77 and the air chamber 90 is shut off. Note that the pressure of all of the atmospheric ports 33, 44, and 89 is the atmospheric pressure, and the pressure of the atmospheric ports 33, 44, and 89 is lower than the pressure of the accumulator chamber 19.

The delay valve 26 is operated in accordance with the state of the switching valve 27. When the switching valve 27 is in the second switch state, the connection between the passage 31 and the passage 77 is shut off, and the air of the passage 31 does not flow into the passage 77. When the compressed air does not flow into the passage 77, the pneumatic pressure of the compression chamber 84 is low. Accordingly, the valve element 79 is biased by the force of the elastic member 81 to close the port 83, and the connection between the passage 77 and the passage 76 is shut off. Therefore, the control port 51 is at the first control pressure, and the shutoff valve 24 is in the first operating state.

When the switching valve 27 is in the first operating state, the passage 31 and the passage 77 are connected, and the compressed air of the passage 33 flows into the passage 77. The compressed air of the passage 77 flows through the passage 80 into the compression chamber 84, and the pressure of the compression chamber 84 increases. After a predetermined time elapses from the time when the air flows into the passage 77, the valve element 79 is operated against the force of the elastic member 81 by the pressure of the compression chamber 84. The port 83 opens when the valve element 79 is operated against the force of the elastic member 81, and the passage 77 is connected to the passage 76. The air of the passage 77 flows into the passage 76, and the pressure of the control port 51 increases from the first control pressure to the second control pressure. Thus, the shutoff valve 24 is switched from the first operating state to the second operating state.

The worker can select the bump fire mode or the single fire mode for the use of the driving tool 10. The bump fire mode will be first described.

(A) Bump Fire Mode

In the bump fire mode, the fasteners S1 are continuously struck by alternately repeating an operation in which the push lever 16 is pressed against the object and an operation in which the push lever 16 is separated from the object in a state where the operating force is applied to the trigger 34.

The state where the operating force is applied to the trigger 34 is referred to as an ON state of the trigger 34, and the state where the operating force to the trigger 34 is released is referred to as an OFF state of the trigger 34. In addition, the operating state of the trigger valve 22 corresponding to the ON state of the trigger 34 is referred to as an ON state of the trigger valve 22, and the operating state of the trigger valve 22 corresponding to the OFF state of the trigger 34 is referred to as an OFF state of the trigger valve 22.

The state where the push lever 16 is separated from the object is referred to as an OFF state of the push lever 16, and the state where the push lever 16 is pressed against the object is referred to as an ON state of the push lever 16. The state of the safety valve 23 corresponding to the OFF state of the push lever 16 is referred to as an OFF state of the safety valve 23. The state of the safety valve 23 corresponding to the ON state of the push lever 16 is referred to as an ON state of the safety valve 23.

Figure 5:
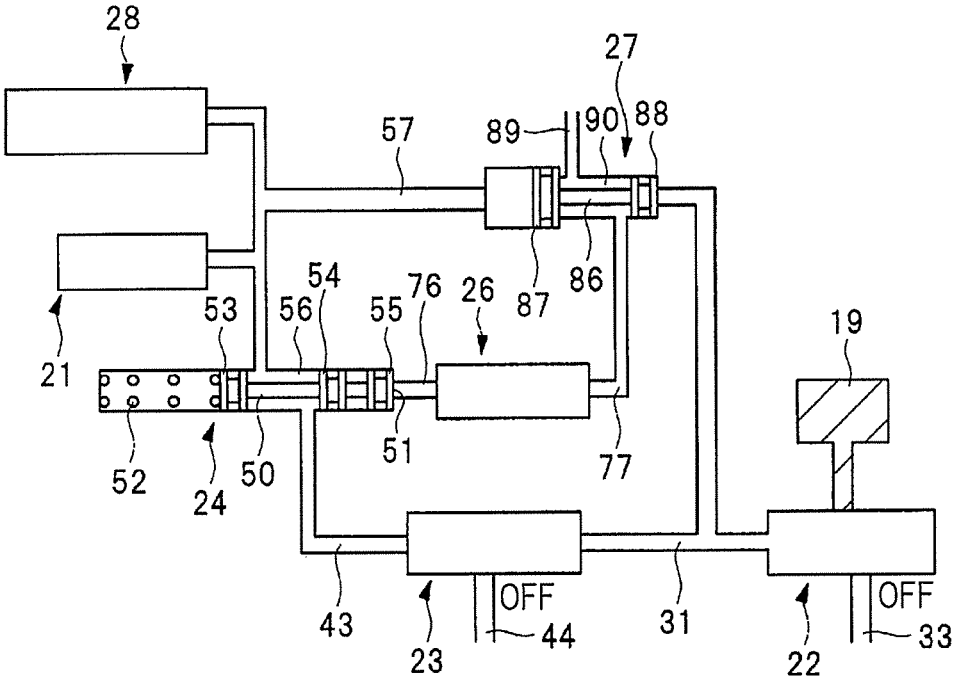
FIG. 5 is a schematic diagram showing the valve mechanism of the driving tool of FIG. 1.

(1-1) The case where the trigger 34 is in the OFF state and the push lever 16 is in the OFF state will be described. As shown in FIG. 2, when the trigger valve 22 is in the OFF state, the connection between the accumulator chamber 19 and the passage 31 is shut off, and the passage 31 is connected to the atmospheric port 33. As shown in FIG. 5, the air of the accumulator chamber 19 is not supplied to the passage 31. As shown in FIG. 2, when the safety valve 23 is in the OFF state, the connection between the passage 31 and the passage 43 is shut off, and the passage 43 and the atmospheric port 33 are connected.

The shutoff valve 24 is in the first operating state as shown in FIG. 2 and FIG. 5, and the passage 43 and the passage 57 are connected. The air of the upper cylinder chamber 21 is discharged to the atmosphere through the air chamber 56 of the shutoff valve 24, the passage 43, and the atmospheric port 33 of the safety valve 23.

As shown in FIG. 3, the cylinder 20 constituting the main valve 25 stops in contact with the stopper 59 by the force of the elastic member 58. Namely, the main valve 25 shuts off the connection between the upper cylinder chamber 21 and the striking chamber 29. Also, the piston 60 and the striker 68 are biased by the pneumatic pressure of the lower cylinder chamber 62, and the piston 60 stops in contact with the stopper 59 at a top dead center.

Note that, when the trigger 34 is in the OFF state and the push lever 16 is in the OFF state, the switching valve 27 is irrelevant to the operation of the driving tool 10 regardless of whether the switching valve 27 is in the first operating state or the second operating state. Therefore, the description of the operation of the switching valve 27 is omitted.

(1-2) Next, an action when the push lever 16 is maintained in the OFF state and the trigger 34 is switched from the OFF state to the ON state will be described with reference to FIG. 4 to FIG. 7.

Figure 6:
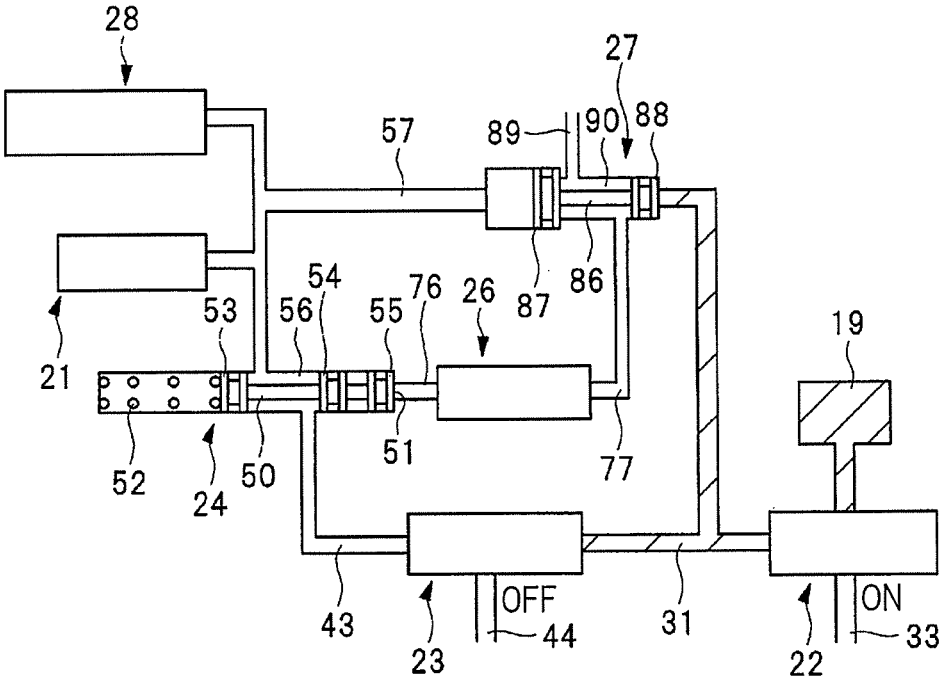
FIG. 6 is a schematic diagram showing the valve mechanism of the driving tool of FIG. 1.

When the push lever 16 is maintained in the OFF state and the trigger 34 is switched from the OFF state to the ON state, the trigger valve 22 connects the accumulator chamber 19 to the passage 31. When the air of the accumulator chamber 19 flows into the passage 31 as shown in FIG. 6, the spool 86 is operated by the difference between the biasing force in accordance with the pneumatic pressure of the passage 31 and the biasing force in accordance with the pneumatic pressure of the passage 57, and the switching valve 27 is brought in the first switch state shown in FIG. 7.

When the switching valve 27 is in the first switch state, the passage 31 and the passage 77 are connected, and the connection between the passage 77 and the atmospheric port 89 is shut off. When the passage 31 and the passage 77 are connected, the air of the accumulator chamber 19 is supplied to the delay valve 26 through the passage 31 and the passage 77, and the pneumatic pressure of the compression chamber 84 starts to increase. When the switching valve 27 is brought in the first switch state and the air of the accumulator chamber 19 is supplied from the passage 31 to the passage 77, the predetermined time starts.

The delay valve 26 closes the port 83 until the predetermined time elapses from the time when the predetermined time starts, and the pneumatic pressure of the control port 51 is at the first control pressure. When the pneumatic pressure of the control port 51 is at the first control pressure, the shutoff valve 24 is maintained in the first operating state. Also, since the push lever 16 is maintained in the OFF state, the safety valve 23 is also maintained in the OFF state.

Figure 8:
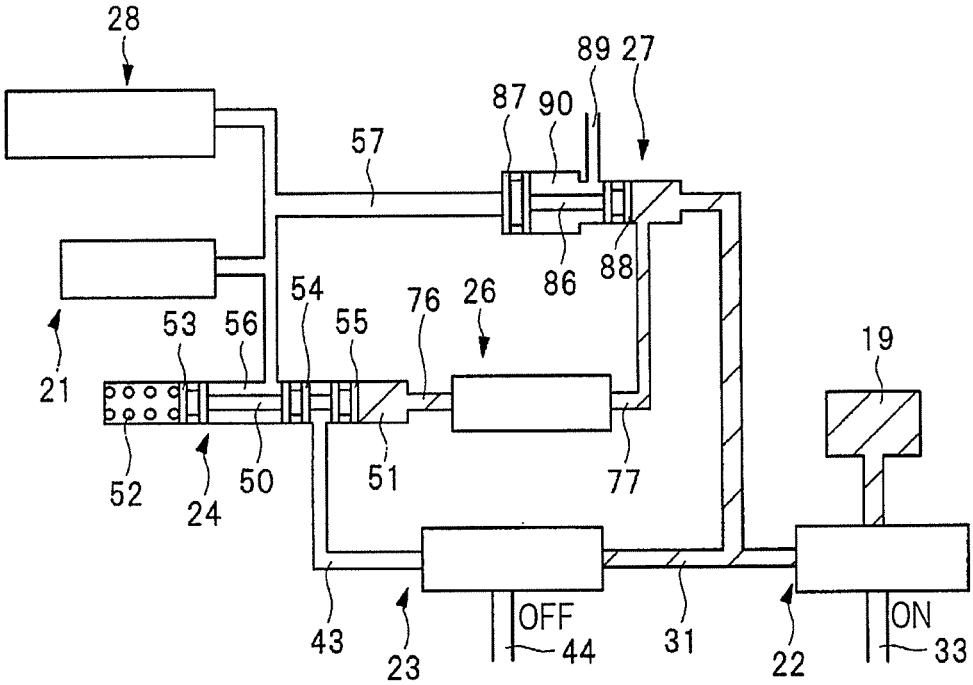
FIG. 8 is a schematic diagram showing the valve mechanism of the driving tool of FIG. 1.
Figure 9:
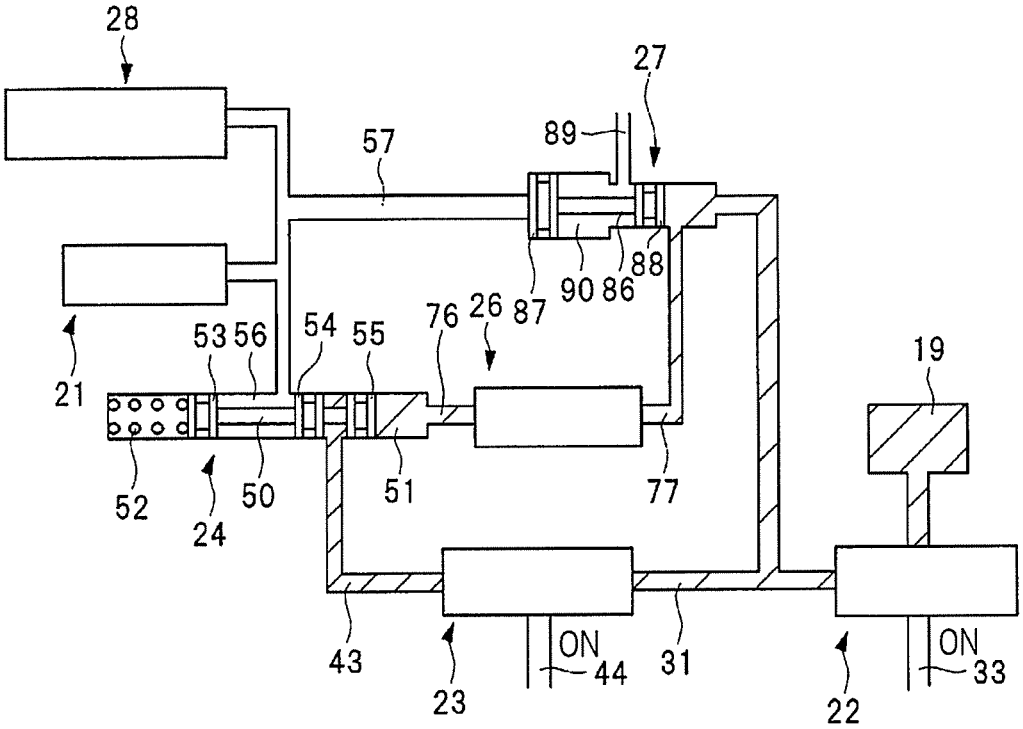
FIG. 9 is a schematic diagram showing the valve mechanism of the driving tool of FIG. 1.

(1-3) An action when the predetermined time elapses from the time when the trigger 34 is brought in the ON state and the predetermined time starts, while maintaining the push lever 16 in the OFF state, will be described with reference to FIG. 8 to FIG. 10. When the predetermined time elapses from the time when the trigger 34 is brought in the ON state, while maintaining the push lever 16 in the OFF state, the valve element 79 is operated by the pneumatic pressure of the compression chamber 84, and the port 83 of the delay valve 26 opens. Then, as shown in FIG. 8, the air of the passage 77 flows into the control port 51 through the passage 76, and the pneumatic pressure of the control port 51 increases from the first control pressure to the second control pressure.

When the pneumatic pressure of the control port 51 is at the second control pressure, the spool 50 is operated against the force of the elastic member 52, and the shutoff valve 24 is brought in the second operating state. The shutoff valve 24 in the second operating state shuts off the connection between the passage 43 and the passage 57. When the shutoff valve 24 is in the second operating state, the air of the accumulator chamber 19 is not transmitted to the passage 57 as shown in FIG. 9 even if the push lever 16 inadvertently comes into contact with the object while the worker is walking and the safety valve 23 is brought in the ON state to connect the passage 31 and the passage 43. Accordingly, the main valve 25 is maintained in the closed state, and the striker 68 does not strike the fastener S1.

As described above, it is possible to prevent the fastener S1 from being accidentally driven in the case where the trigger 34 is maintained in the ON state and the push lever 16 inadvertently comes into contact with the object after the predetermined time elapses from the time when the predetermined time starts.

Figure 10:
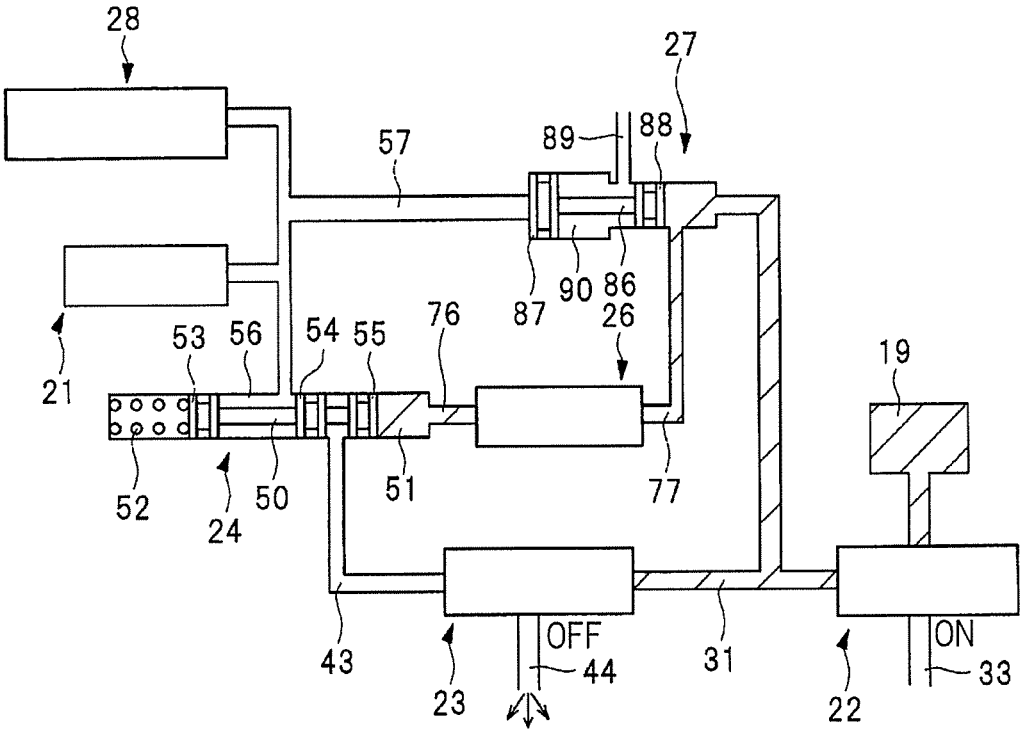
FIG. 10 is a schematic diagram showing the valve mechanism of the driving tool of FIG. 1.

Thereafter, when the push lever 16 is separated from the object and the safety valve 23 is brought in the OFF state, the air which has flown in the passage 43 from the accumulator chamber 19 is discharged from the atmospheric port 33 of the safety valve 23 as shown in FIG. 10.

Figure 11:
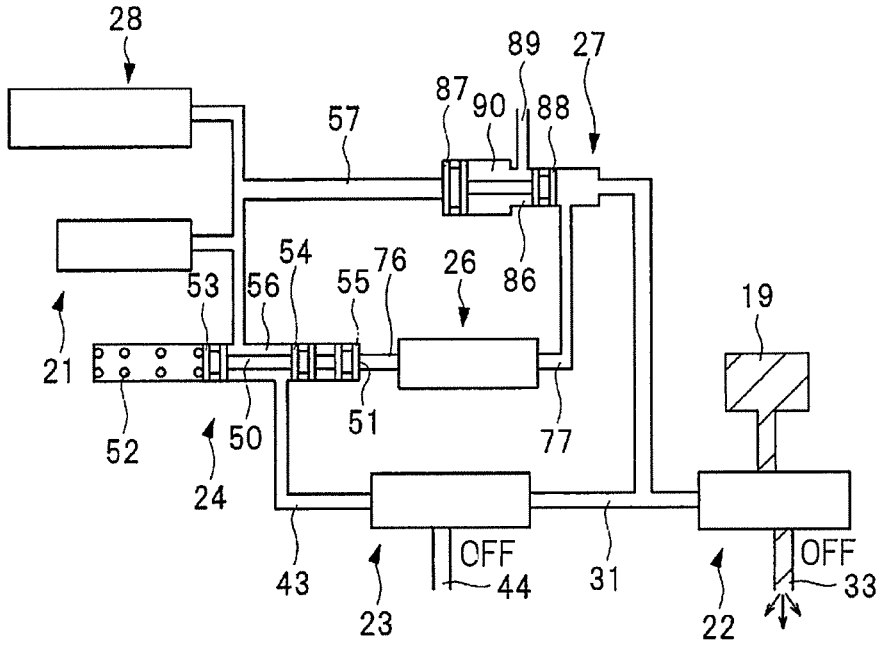
FIG. 11 is a schematic diagram showing the valve mechanism of the driving tool of FIG. 1.

(1-4) The action when the state in which the trigger 34 is in the ON state and the push lever 16 is in the OFF state is changed to the state in which the trigger 34 is in the ON state and the push lever 16 is in the OFF state will be described with reference to FIG. 2 and FIG. 11. When the trigger valve 22 is in the OFF state, the connection between the accumulator chamber 19 and the passage 31 is shut off, and the passage 31 and the atmospheric port 33 are connected. Accordingly, the air of the passage 77 is discharged from the atmospheric port 33 through the passage 31, and the port 83 of the delay valve 26 is closed. Thus, the pneumatic pressure of the control port 51 decreases from the second control pressure to the first control pressure, and the operating state of the shutoff valve 24 is switched from the second operating state to the first operating state.

Figure 12:
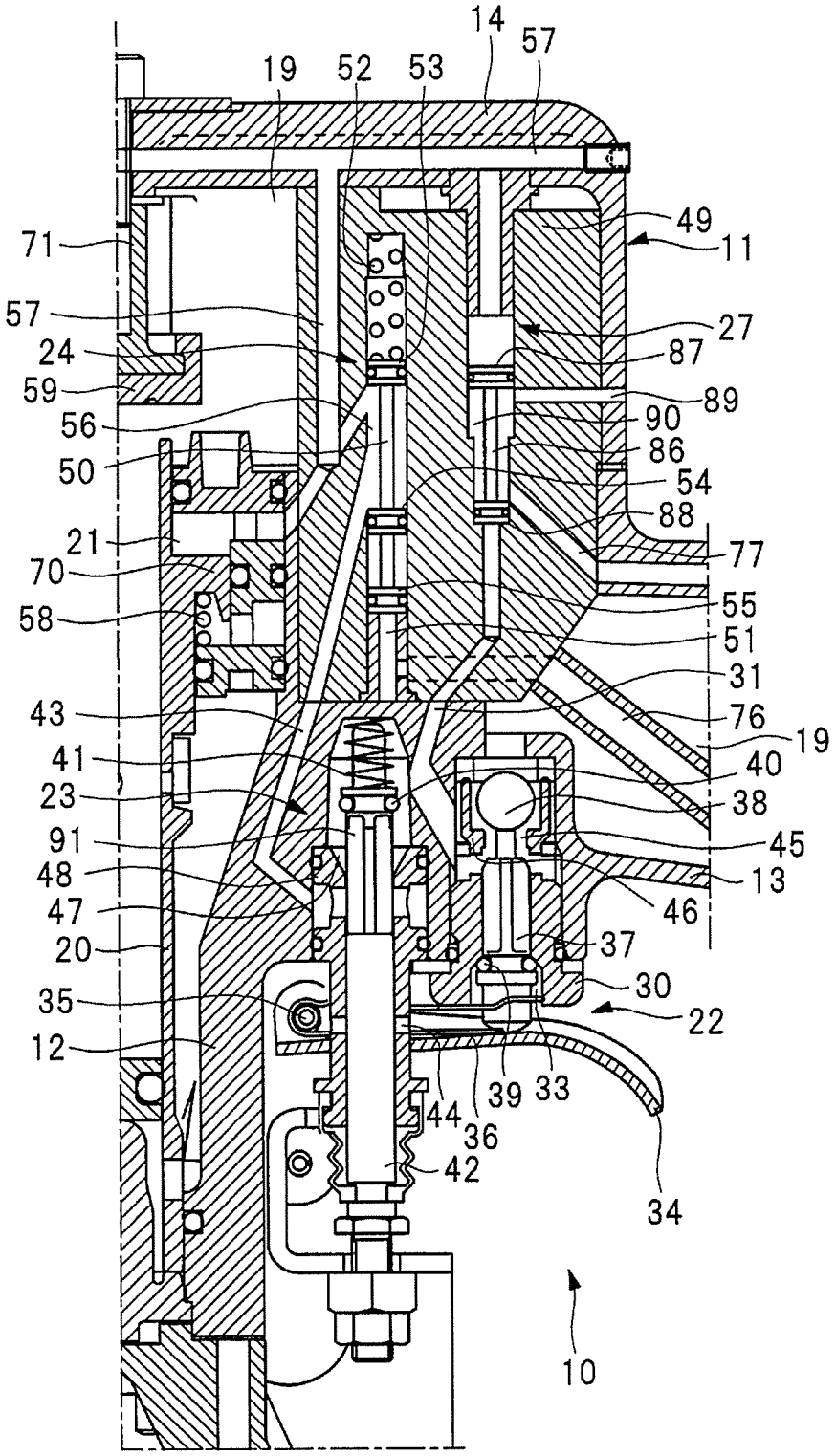
FIG. 12 is a longitudinal cross-sectional view showing the valve mechanism of the driving tool of FIG. 1.
Figure 13:
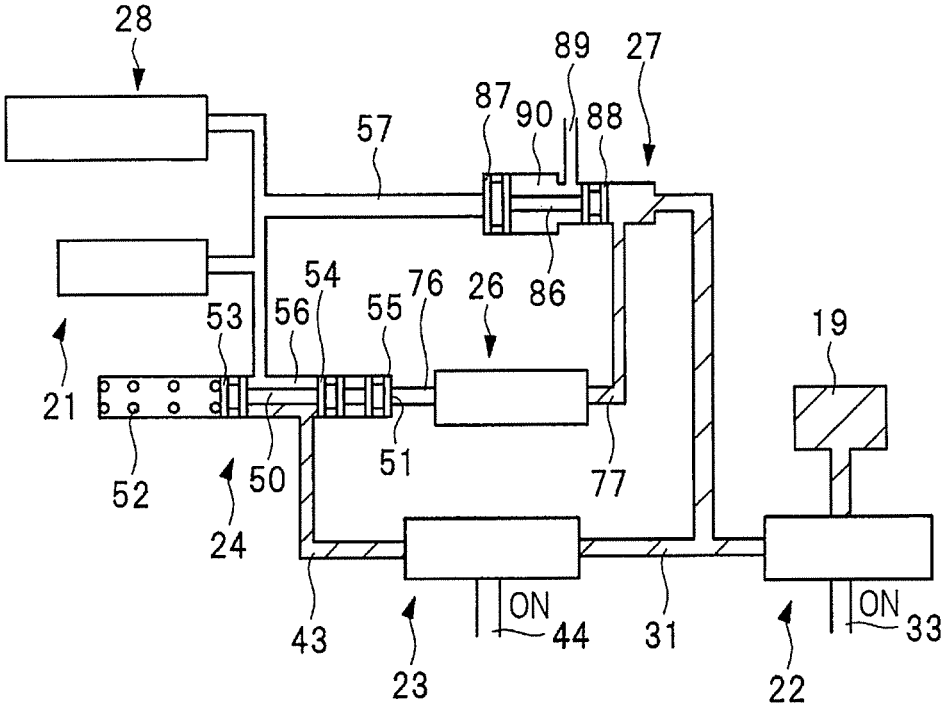
FIG. 13 is a schematic diagram showing the valve mechanism of the driving tool of FIG. 1.

(2-1) Next, the action when the push lever 16 is brought in the ON state before the predetermined time elapses from the time when the predetermined time starts will be described. When the push lever 16 is brought in the ON state before the predetermined time elapses from the time when the predetermined time starts, the safety valve 23 is switched from the OFF state to the ON state, and the safety valve 23 connects the passage 31 and the passage 43 as shown in FIG. 12. Then, the air of the accumulator chamber 19 flows into the air chamber 56 of the shutoff valve through the passages 31 and 43 as shown in FIG. 13.

Figure 14:
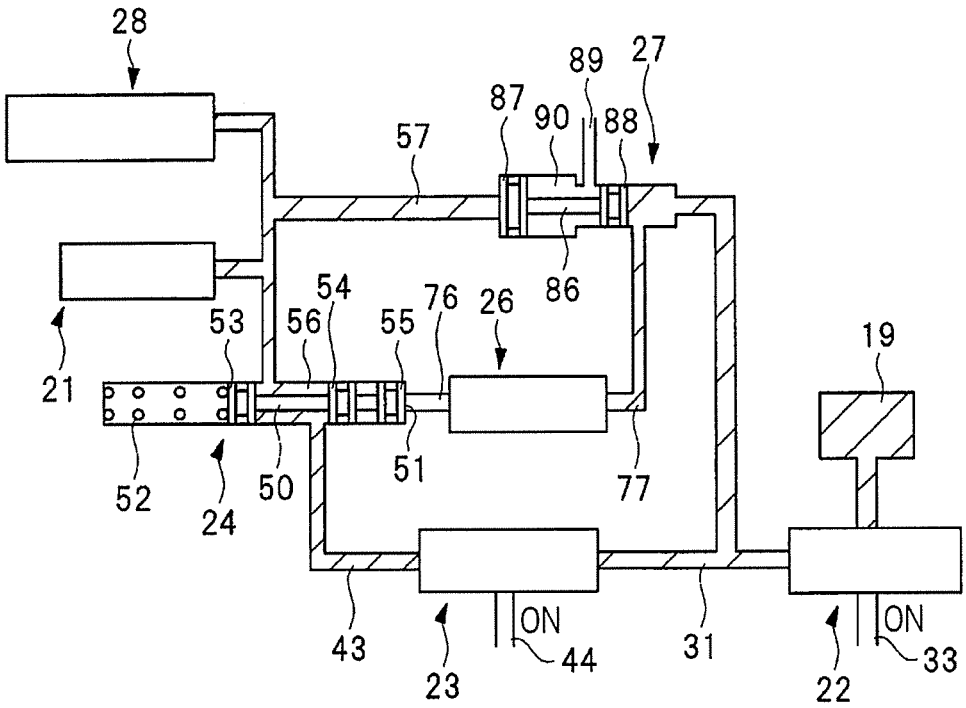
FIG. 14 is a schematic diagram showing the valve mechanism of the driving tool of FIG. 1.
Figure 15:
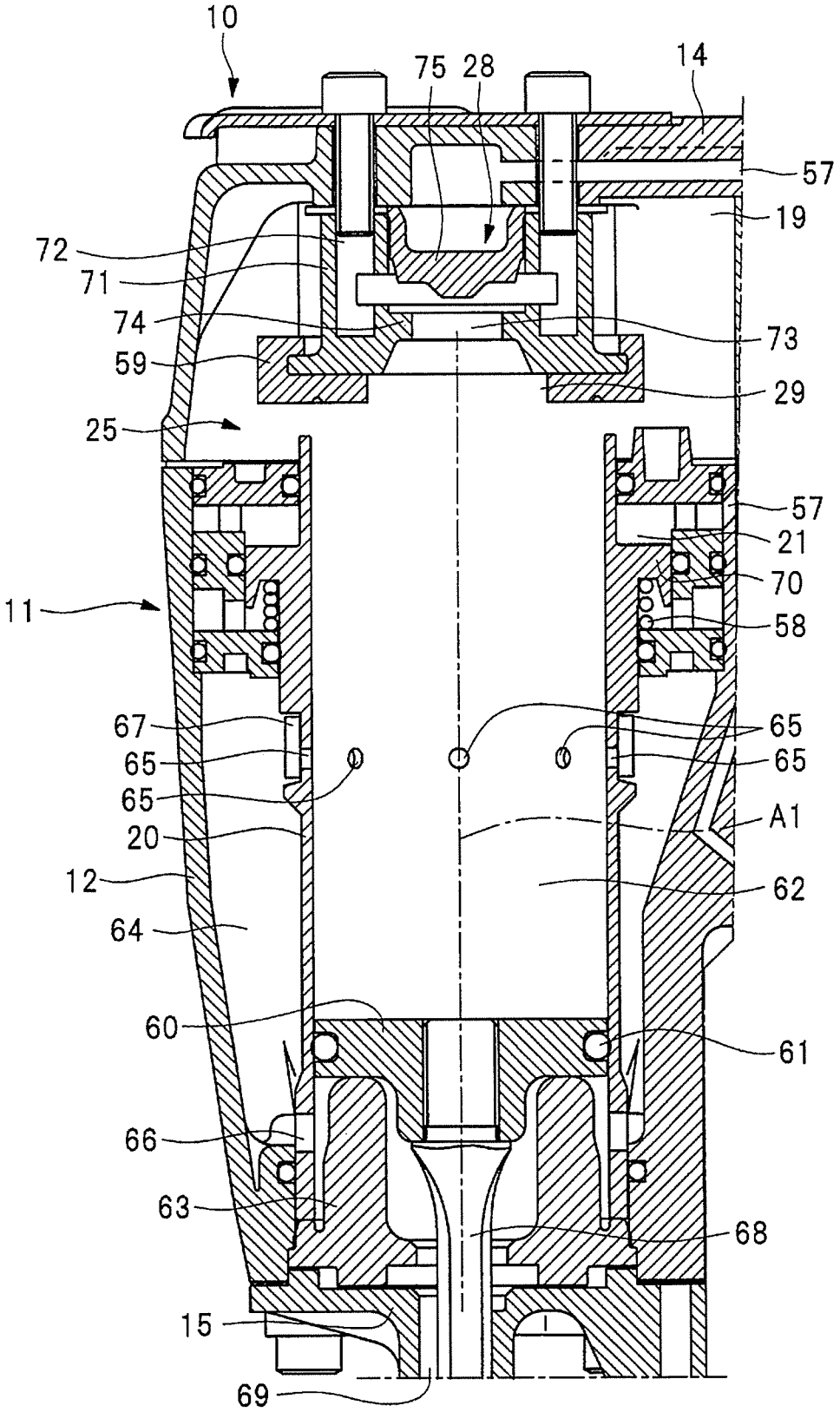
FIG. 15 is a longitudinal cross-sectional view showing the valve mechanism of the driving tool of FIG. 1.

Further, as shown in FIG. 14, the air of the air chamber 56 flows into the exhaust valve 28 and the upper cylinder chamber 21. As shown in FIG. 15, the exhaust valve 28 is closed by the pneumatic pressure of the passage 57, and the cylinder 20 descends against the force of the elastic member 58 by the pneumatic pressure of the upper cylinder chamber 21. As a result, the air of the accumulator chamber 19 flows into the striking chamber 29 through the space between the piston 60 and the stopper 59, and the pneumatic pressure of the striking chamber 29 increases. The piston 60 is struck by the pneumatic pressure of the striking chamber 29, and the piston 60 and the striker 68 are moved in the direction of the center line A1, so that the striker 68 strikes the fastener S1.

Figure 16:
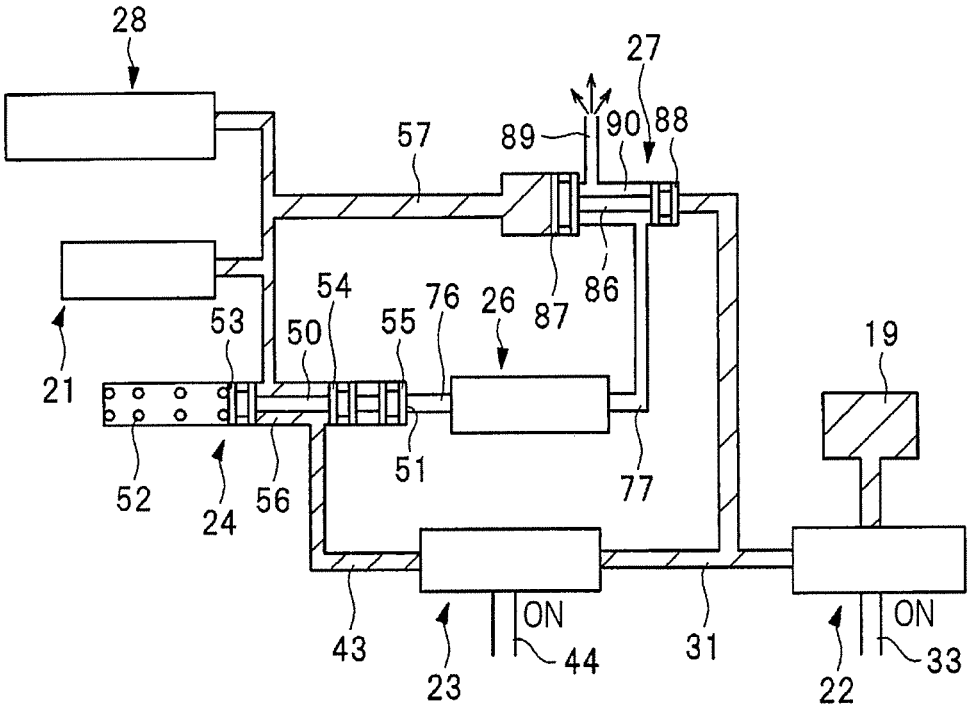
FIG. 16 is a schematic diagram showing the valve mechanism of the driving tool of FIG. 1.

Also, the pneumatic pressure of the passage 57 is applied to the land portion 87 of the switching valve 27, and the spool 86 of the switching valve 27 is operated by the difference between the force in accordance with the pressure receiving area of the land portion 87 and the force in accordance with the pressure receiving area of the land 88. Accordingly, as shown in FIG. 16, the switching valve 27 is brought in the second switch state, shuts off the connection between the passage 31 and the passage 77, and connects the passage 77 and the atmospheric port 89. Therefore, the air which has flown in the delay valve 26 is discharged through the passage 77 and the atmospheric port 89, and the valve element 79 is moved by the force of the elastic member 81, so that the port 83 is closed.

While the piston 60 is descending, the air of the lower cylinder chamber 62 flows into the return air chamber 64, and the pneumatic pressure of the return air chamber 64 increases. Also, after the striker 68 has struck the fastener S1, a part of the pneumatic pressure of the striking chamber 29 flows into the return air chamber 64 through the passage 65. Then, as shown in FIG. 15, the piston 60 collides with the damper 63, and the damper 63 is elastically deformed, so that the impact of the striking is absorbed by the damper 63.

Subsequently, when the push lever 16 is switched from the ON state to the OFF state while the worker maintains the trigger 34 in the ON state, the air of the passage 57 is discharged from the atmospheric port 33 through the shutoff valve 24 and the passage 43. Then, the pneumatic pressure of the upper cylinder chamber 21 decreases, so that the cylinder 20 ascends by the force of the elastic member 58 and stops in contact with the stopper 59 at a top dead center. In other words, the main valve 25 shuts off the connection between the striking chamber 29 and the upper cylinder chamber 21.

As a result, the pneumatic pressure of the striking chamber 29 decreases, and the piston 60 and the striker 68 ascend by the pneumatic pressure of the return air chamber 64 to open the port 73, so that the air of the striking chamber 29 is discharged to the atmosphere from the atmospheric port 72. Also, the piston 60 is pressed to the stopper 59 and stops at a top dead center.

As described above, when the pneumatic pressure of the passage 57 decreases, the switching valve 27 is operated by the pneumatic pressure of the passage 31, and the passage 31 and the passage 77 are connected, so that the air of the accumulator chamber 19 flows into the delay valve 26 through the passages 31 and 77 and the atmospheric port 89 is shut off. Namely, each valve returns to the state of FIG. 7 and prepares for the next striking.

As described above, when the push lever 16 is switched from the OFF state to the ON state to strike the fastener S1 before the predetermined time elapses from the time when the switching valve 27 is brought in the first switch state and the air of the accumulator chamber 19 flows into the passage, the switching valve 27 is switched from the first switch state to the second switch state, shuts off the connection between the passage 31 and the passage 77, and connects the passage 77 and the atmospheric port 89. Therefore, the port 83 of the delay valve 26 is shut off, and the control port 51 is maintained at the first control pressure. Namely, the shutoff valve 24 is maintained in the first operating state.

Therefore, when the push lever 16 is brought in the OFF state after striking and the push lever 16 is brought in the ON state again, the air of the accumulator chamber 19 flows into the upper cylinder chamber 21 through the passages 31 and 43, the main valve 25 is operated to increase the pneumatic pressure of the striking chamber 29, so that the striker 68 descends to strike the fastener S1. Accordingly, it is possible to smoothly perform the bump firing. In other words, it is not necessary to once switch the trigger 34 from the ON state to the OFF state and then return the trigger 34 to the ON state again in the bump firing.

(3-1) Next, the action when the trigger 34 is brought in the ON state and the predetermined time starts, and the trigger 34 is then switched from the ON state to the OFF state while the push lever 16 is maintained in the OFF state will be described with reference to FIG. 7 and FIG. 11.

Figure 7:
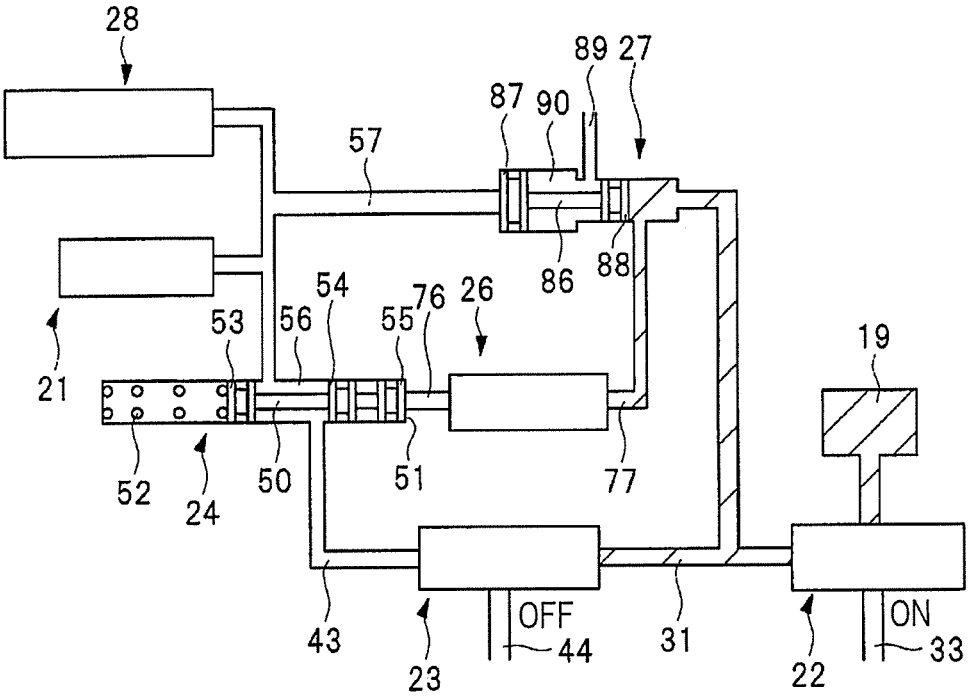
FIG. 7 is a schematic diagram showing the valve mechanism of the driving tool of FIG. 1.

When the trigger 34 is brought in the ON state, the switching valve 27 is brought in the first switch state as shown in FIG. 7.

Namely, the air of the accumulator chamber 19 flows into the passage 77 from the passage 31. When the push lever 16 is maintained in the OFF state and the trigger 34 is switched from the ON state to the OFF state before the predetermined time elapses from the time when the air of the accumulator chamber 19 flows into the passage 77 from the passage 31, the trigger valve 22 shuts off the connection between the accumulator chamber 19 and the passage 31, and connects the passage 31 and the atmospheric port 33. Accordingly, as shown in FIG. 11, the air of the passage 77 is discharge from the atmospheric port 33 through the passage 31. Therefore, the pneumatic pressure of the control port 51 is maintained at the first control pressure.

(B) Single Fire Mode

An example of the use of the driving tool 10 in the single fire mode will be described with reference to FIG. 3, FIG. 12, FIG. 15, FIG. 17, and FIG. 18. The worker carries out a first operation of striking the fastener S1 by switching the trigger 34 in the OFF state to the ON state and the push lever 16 in the OFF state to the ON state. Then, the worker carries out a second operation of switching the trigger 34 to the OFF state and the push lever 16 to the OFF state. In the single fire mode, the worker repeats the first operation and the second operation to drive the fastener S1 to the object one by one.

Figure 17:
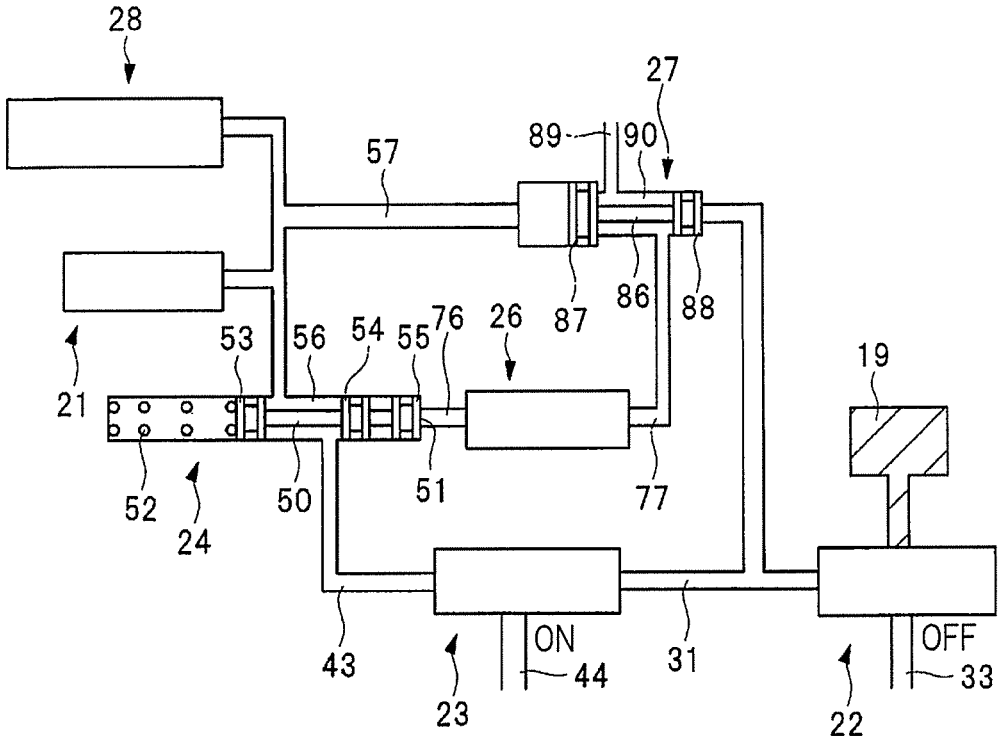
FIG. 17 is a schematic diagram showing the valve mechanism of the driving tool of FIG. 1.

In the case of the single fire mode, the worker first switches the trigger 34 to the OFF state and the push lever 16 to the ON state. When the push lever 16 is in the ON state, the safety valve 23 connects the passage 31 and the passage 43. However, when the trigger 34 is in the OFF state, the air of the accumulator chamber 19 is not supplied to the passage 31 as shown in FIG. 17.

Figure 18:
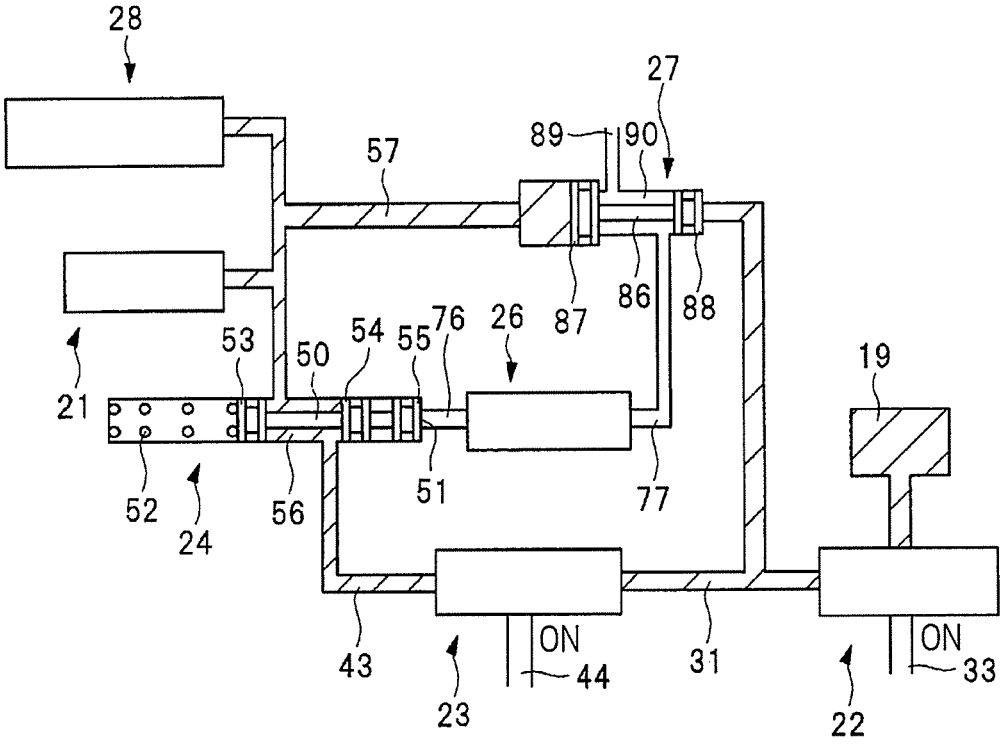
FIG. 18 is a schematic diagram showing the valve mechanism of the driving tool of FIG. 1.

When the trigger 34 is brought in the ON state while the push lever 16 is in the ON state as shown in FIG. 12, the trigger valve 22 connects the accumulator chamber 19 and the passage 31. Accordingly, the air of the accumulator chamber 19 is supplied to the upper cylinder chamber 21 and the exhaust valve 28 through the passages 31, 43, and 57 as shown in FIG. 18. Then, the cylinder 20 descends by the pneumatic pressure of the upper cylinder chamber 21, and the port 73 is closed to increase the pneumatic pressure of the striking chamber 29, so that the striker 68 strikes the fastener S1 as shown in FIG. 15. After the striker 68 strikes the fastener S1, the cylinder 20 ascends by the force of the elastic member 58 and stops in contact with the stopper 59. In addition, the piston 60 ascends by the pneumatic pressure of the lower cylinder chamber 62, and the piston 60 stops in contact with the stopper 59 at a top dead center.

In the case of the single fire mode, the worker switches the trigger 34 to the OFF state after the fastener S1 is struck, and further switches the push lever 16 to the OFF state. Thereafter, the above-described operations are repeated.

In the case of the single fire mode, as shown in FIG. 18, when the air of the accumulator chamber 19 flows into the passage 57, the switching valve 27 is brought in the second switch state, so that the connection between the passage 31 and the passage 77 is shut off and the passage 77 and the atmospheric port 89 are connected. Namely, in the single fire mode, the air of the accumulator chamber 19 is not supplied to the delay valve 26.

The conditions for determining the "predetermined time" in the embodiment of the driving tool 10 include the spring constant of the elastic member 81, the volume of the compression chamber 84, and the flow area of the passage 80. For example, on the premise that the other conditions are the same, the predetermined time becomes longer as the spring constant of the elastic member 81 is larger, and the predetermined time becomes shorter as the spring constant of the elastic member 81 is smaller. Also, on the premise that the other conditions are the same, the predetermined time becomes longer as the volume of the compression chamber 84 is larger, and the predetermined time becomes shorter as the volume of the compression chamber 84 is smaller.

Further, on the premise that the other conditions are the same, the predetermined time becomes longer as the flow area of the passage 80 is narrower, and the predetermined time becomes shorter as the flow area of the passage 80 is wider.

The predetermined time is from the time when the switching valve 27 is brought in the first switch state and the passage 31 and the passage 77 are connected to the time when the port 83 of the delay valve 26 opens and the pneumatic pressure of the control port 51 changes from the first control pressure to the second control pressure. Namely, it is only required to have a time difference between the time when the switching valve 27 is operated to connect the passage 31 and the passage 77 and the time when the pneumatic pressure of the control port 51 changes from the first control pressure to the second control pressure.

In the configuration described in the embodiment, the passage 31 corresponds to a first passage, and the passage 43 corresponds to a second passage. Also, the passage 57 corresponds to a third passage, the port 83 corresponds to a supply port, the delay valve 26 corresponds to a control valve, the passage 77 corresponds to a fourth passage, and the atmospheric port 89 corresponds to an atmospheric port. The state in which the port 83 of the delay valve 26 is closed is the first control state, and the state in which the port 83 of the delay valve 26 opens is the second control state.

Further, the state in which an operating force is applied to the trigger 34 is the operating state of the trigger 34, and the state in which the operating force to the trigger 34 is released is the non-operating state of the trigger 34. The state in which the push lever 16 is pressed against the object is the operating state of the push lever 16, and the state in which the push lever 16 is separated from the object is the non-operating state of the push lever 16.

Also, supplying the compressed air of the accumulator chamber to the cylinder means that the cylinder 20 is separated from the stopper 59 and the compressed air is supplied to the striking chamber 29 to drive the striker 68.

It is needless to say that the driving tool is not limited to the embodiment and various modifications and alterations can be made within the scope of the present invention. For example, a trigger is an element that transmits an operating force of a worker to a first opening/closing valve, and the trigger includes a lever that rotates around a support shaft and a button that is operable along a guide rail. A push lever is an element that transmits a moving force generated by pressing the push lever to an object to a second opening/closing valve, and the push lever may have any of tubular and bar-like shapes. A fastener may be any of a rod-shaped nail and a U-shaped tacker.

EXPLANATION OF REFERENCE CHARACTERS

10: driving tool, 19: accumulator chamber, 16: push lever, 22: trigger valve, 23: safety valve, 24: shutoff valve, 25: main valve, 26: delay valve, 27: switching valve, 29: striking chamber (upper piston chamber), 31, 43, 57, 77: passage, 34: trigger, 51: control port, 62: lower cylinder chamber, 68: striker, 83: port, 89: atmospheric port, S1: fastener

The invention claimed is:

1. A driving tool comprising:

a housing;

an accumulator chamber which accumulates compressed air in the housing;

a nose section provided on the housing;

a cylinder provided in the housing;

a trigger provided on the housing;

a push lever provided in the nose section and allowed to abut on a material to which driving is performed, the trigger and the push lever being operated such that the compressed air of the accumulator chamber is supplied to the cylinder;

a shutoff valve which has (1) a first position that connects a passage of the compressed air between the accumulator chamber and the cylinder and (2) a second position that shuts off the passage of the compressed air;

a control valve which supplies the compressed air of the accumulator chamber to the shutoff valve to control the shutoff valve, the shutoff valve being operated by the compressed air from the control valve to move from the first position to the second position; and a switching valve which has (1) a first switch state that connects a passage of the compressed air between the accumulator chamber and the control valve to allow the control valve to control the shutoff valve to change from the first position to the second position and (2) a second switch state that shuts off the passage of the compressed air between the accumulator chamber and the control valve not to allow the control valve to control the shutoff valve to change from the first position to the second position, wherein the driving tool has (1) a bump fire mode in which a first driving operation is performed when the push lever is operated in a state where the trigger is being operated, and (2) a single fire mode in which a second driving operation is performed when the trigger is operated in a state where the push lever is being operated, wherein, in the bump fire mode, the shutoff valve is at the first position to enable the first driving operation when the push lever is operated within a predetermined time after the trigger is operated, wherein, in the bump fire mode, the switching valve is in the first switch state, and the control valve controls the shutoff valve to move from the first position to the second position to disable the first driving operation when the push lever is not operated within the predetermined time after the trigger is operated, wherein, in the single fire mode, the switching valve is in the second switch state, and the shutoff valve is at the first position to enable the second driving operation, wherein the driving tool further comprises:

a trigger valve operated by a moving force of the trigger to connect or shut off a first passage communicating with the accumulator chamber;

a safety valve operated by a moving force of the push lever to connect or shut off a second passage communicating with the shutoff valve;

a third passage formed between the second passage and the cylinder;

a main valve operated by a pneumatic pressure of the third passage to establish or shut off a connection between the accumulator chamber and the cylinder;

the shutoff valve operated by a pneumatic pressure of a control port to establish or shut off a connection between the second passage and the third passage;

a supply port which supplies the compressed air of the accumulator chamber to the control port;

the control valve having a first control state in which the supply port is closed to change the pneumatic pressure of the control port to a first control pressure and a second control state in which the supply port is opened to change the pneumatic pressure of the control port to a second control pressure higher than the first control pressure;

a fourth passage connected to the supply port; and the switching valve having the first switch state in which the first passage and the fourth passage are connected and the second switch state in which the connection between the first passage and the fourth passage is shut off, wherein the switching valve is brought in the first switch state when the accumulator chamber and the first passage are connected by the trigger valve in a state where the connection between the first passage and the second passage is shut off by the safety valve, wherein the control valve is in the first control state until a predetermined time elapses from a time when the switching valve is brought in the first switch state and the first control state is switched to the second control state when the predetermined time has elapsed, and wherein the switching valve is switched from the first switch state to the second switch state when the first passage and the second passage are connected by the safety valve and the compressed air of the accumulator chamber is supplied to a striking chamber such that a striker strikes a fastener before the predetermined time has elapsed.

2. The driving tool according to claim 1, wherein the switching valve supplies the compressed air to the control valve when the trigger is operated, and discharges the compressed air supplied to the control valve to outside of the housing when the push lever is operated within the predetermined time in the bump fire mode.

3. The driving tool according to claim 1, wherein the switching valve includes an atmospheric port having a pressure lower than a pneumatic pressure of the accumulator chamber, and when the switching valve is in the first switch state, a connection between the fourth passage and the atmospheric port is shut off, and when the switching valve is in the second switch state, the fourth passage and the atmospheric port are connected.

4. The driving tool according to claim 1, wherein the switching valve is operated by the pneumatic pressure of the third passage and is switched from the first switch state to the second switch state.

5. The driving tool according to claim 1, wherein, when the accumulator chamber and the first passage are connected and the connection between the first passage and the second passage is shut off, the switching valve is operated by a pneumatic pressure of the first passage and is switched from the second switch state to the first switch state.

6. The driving tool according to claim 1, wherein, when the accumulator chamber and the first passage are connected, the first passage and the second passage are connected, and the second passage and the third passage are connected, the switching valve is switched from the first switch state to the second switch state.

7. A driving tool having a housing;

an accumulator chamber which accumulates compressed air in the housing;

a nose section provided on the housing;

a cylinder provided in the housing;

a trigger provided on the housing;

a push lever provided in the nose section and allowed to abut on a material to which driving is performed, the trigger and the push lever being operated such that the compressed air of the accumulator chamber is supplied to the cylinder;

a shutoff valve which has (1) a first position that connects a passage of the compressed air between the accumulator chamber and the cylinder and (2) a second position that shuts off the passage of the compressed air; and a control valve which supplies the compressed air of the accumulator chamber to the shutoff valve to control the shutoff valve, the shutoff valve being operated by the compressed air from the control valve to move from the first position to the second position; and a switching valve which has (1) a first switch state that connects a passage of the compressed air between the accumulator chamber and the control valve to allow the control valve to control the shutoff valve to change from the first position to the second position and (2) a second switch state that shuts off the passage of the compressed air between the accumulator chamber and the control valve not to allow the control valve to control the shutoff valve to change from the first position to the second position, wherein the driving tool has (1) a bump fire mode in which a first driving operation is performed when the push lever is operated in a state where the trigger is being operated, and (2) a single fire mode in which a second driving operation is performed when the trigger is operated in a state where the push lever is being operated, wherein, in the bump fire mode, the shutoff valve is at the first position to enable the first driving operation when the push lever is operated within a predetermined time after the trigger is operated, wherein the control valve has a first position at which the first and second driving operations are enabled and a second position at which the first and second driving operations are disabled, and is configured to be operated by the compressed air to move between the first position and the second position, wherein, in the bump fire mode, the switching valve is in the first switch state, and the control valve moves from the first position to the second position to control the shutoff valve to move from the first position to the second position when the push lever is not operated within a predetermined time after the trigger is operated in the bump fire mode, wherein the control valve maintains the first position in the single fire mode, wherein the driving tool further comprises:

a trigger valve operated by a moving force of the trigger to connect or shut off a first passage communicating with the accumulator chamber;

a safety valve operated by a moving force of the push lever to connect or shut off a second passage communicating with the shutoff valve;

a third passage formed between the second passage and the cylinder;

a main valve operated by a pneumatic pressure of the third passage to establish or shut off a connection between the accumulator chamber and the cylinder;

the shutoff valve operated by a pneumatic pressure of a control port to establish or shut off a connection between the second passage and the third passage;

a supply port which supplies the compressed air of the accumulator chamber to the control port;

the control valve having a first control state in which the supply port is closed to change the pneumatic pressure of the control port to a first control pressure and a second control state in which the supply port is opened to change the pneumatic pressure of the control port to a second control pressure higher than the first control pressure;

a fourth passage connected to the supply port; and the switching valve having the first switch state in which the first passage and the fourth passage are connected and the second switch state in which the connection between the first passage and the fourth passage is shut off, wherein the switching valve is brought in the first switch state when the accumulator chamber and the first passage are connected by the trigger valve in a state where the connection between the first passage and the second passage is shut off by the safety valve, wherein the control valve is in the first control state until a predetermined time elapses from a time when the switching valve is brought in the first switch state and the first control state is switched to the second control state when the predetermined time has elapsed, and wherein the switching valve is switched from the first switch state to the second switch state when the first passage and the second passage are connected by the safety valve and the compressed air of the accumulator chamber is supplied to a striking chamber such that a striker strikes a fastener before the predetermined time has elapsed.

8. A driving tool having a bump fire mode and a single fire mode to perform a driving operation using compressed air, the bump fire mode and the single fire mode being switched by an operation order of a trigger and a push lever, in which the bump fire mode is selected when the push lever is operated after the trigger is operated and the single fire mode is selected when the trigger is operated after the push lever is operated, the driving tool comprising:

a shutoff valve which has (1) a first position that opens a passage to provide the compressed air to perform the driving operation and (2) a second position that shut off the passage of the compressed air;

a control valve configured to control the shutoff valve to have the second position to disable the driving operation when the trigger is operated in a state where the push lever is not operated and the push lever is not operated within a predetermined time after the trigger is operated, the shutoff valve being operated by an compressed air from the control valve to move from the first position to the second position;

a switching valve which has (1) a first switch state that connects a passage of the compressed air between an accumulator chamber and the control valve to allow the control valve to control the shutoff valve to change from the first position to the second position and (2) a second switch state that shuts off the passage of the compressed air between the accumulator chamber and the control valve not to allow the control valve to control the shutoff valve to change from the first position to the second position;

a trigger valve operated by a moving force of the trigger to connect or shut off a first passage communicating with the accumulator chamber;

a safety valve operated by a moving force of the push lever to connect or shut off a second passage communicating with the shutoff valve;

a third passage formed between the second passage and the cylinder;

a main valve operated by a pneumatic pressure of the third passage to establish or shut off a connection between the accumulator chamber and the cylinder;

the shutoff valve operated by a pneumatic pressure of a control port to establish or shut off a connection between the second passage and the third passage;

a supply port which supplies the compressed air of the accumulator chamber to the control port;

the control valve having a first control state in which the supply port is closed to change the pneumatic pressure of the control port to a first control pressure and a second control state in which the supply port is opened to change the pneumatic pressure of the control port to a second control pressure higher than the first control pressure;

a fourth passage connected to the supply port; and the switching valve having the first switch state in which the first passage and the fourth passage are connected and the second switch state in which the connection between the first passage and the fourth passage is shut off, wherein the switching valve is brought in the first switch state when the accumulator chamber and the first passage are connected by the trigger valve in a state where the connection between the first passage and the second passage is shut off by the safety valve, wherein the control valve is in the first control state until a predetermined time elapses from a time when the switching valve is brought in the first switch state and the first control state is switched to the second control state when the predetermined time has elapsed, and wherein the switching valve is switched from the first switch state to the second switch state when the first passage and the second passage are connected by the safety valve and the compressed air of the accumulator chamber is supplied to a striking chamber such that a striker strikes a fastener before the predetermined time has elapsed.

* * * * *